US010697599B1

(12) United States Patent
Davis et al.

(10) Patent No.: US 10,697,599 B1
(45) Date of Patent: Jun. 30, 2020

(54) ADJUSTABLE LIGHT FIXTURES

(71) Applicant: Eaton Intelligent Power Limited, Dublin (IE)

(72) Inventors: Jared Davis, Newnan, GA (US); Rongxiu (Rick) Huang, Shanghai (CN); Steven Pyshos, Peachtree City, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/250,405

(22) Filed: Jan. 17, 2019

(51) Int. Cl.

| | |
|---|---|
| ***F21V 31/00*** | (2006.01) |
| ***F21S 8/02*** | (2006.01) |
| ***F21V 21/30*** | (2006.01) |
| ***F21K 9/65*** | (2016.01) |
| ***F21K 9/69*** | (2016.01) |

(52) U.S. Cl.
CPC ..... *F21S 8/024* (2013.01); *F21K 9/65* (2016.08); *F21K 9/69* (2016.08); *F21V 21/30* (2013.01)

(58) Field of Classification Search
CPC .. F21S 8/02; F21S 8/026; F21V 31/00; F21V 31/005
See application file for complete search history.

(56) References Cited

U.S. PATENT DOCUMENTS

| | | | | |
|---|---|---|---|---|
| 5,738,436 | A * | 4/1998 | Cummings | F21V 29/773 362/294 |
| 6,033,083 | A * | 3/2000 | Reinert, Sr. | B64F 1/20 362/153.1 |
| 2007/0215027 | A1* | 9/2007 | MacDonald | B63B 45/02 114/66 |
| 2017/0299159 | A1* | 10/2017 | Mjelde | F21V 21/14 |

* cited by examiner

*Primary Examiner* — Andrew J Coughlin
(74) *Attorney, Agent, or Firm* — King & Spalding LLP

(57) ABSTRACT

An adjustable light fixture can include a housing comprising at least one wall that forms a first cavity. The adjustable light fixture can also include a first sealing member coupled to the at least one wall and at least partially disposed within the first cavity. The adjustable light fixture can further include a body movably coupled to the housing and at least partially disposed within the first cavity, where the body is configured to have multiple positions relative to the housing, where the first sealing member abuts against an outer surface of the body when the body is in each of the positions, where the first sealing member prevents fluids in an ambient environment from traversing therethrough when the body is in each of the positions, where the positions includes the body having a tilt angle relative to the housing of greater than 20°.

20 Claims, 7 Drawing Sheets

ADJUSTABLE LIGHT FIXTURES

TECHNICAL FIELD

Embodiments described herein relate generally to light fixtures, and more particularly to systems, methods, and devices for adjustable light fixtures.

BACKGROUND

Light fixtures can have a number of different shapes, sizes, configurations, and light sources. For example, low profile light fixtures can sometimes be adjustable. However, difficulties can arise when adjustable light fixtures are required to meet certain standards in order to be located in certain environments.

SUMMARY

In general, in one aspect, the disclosure relates to an adjustable light fixture that can include a housing having at least one wall that forms a first cavity. The adjustable light fixture can also include a first sealing member coupled to the at least one wall and at least partially disposed within the first cavity. The adjustable light fixture can further include a body movably coupled to the housing and at least partially disposed within the first cavity, where the body is configured to have a plurality of positions relative to the housing, where the first sealing member abuts against an outer surface of the body when the body is in each of the plurality of positions, where the first sealing member prevents fluids in an ambient environment from traversing therethrough when the body is in each of the plurality of positions, where the plurality of positions includes the body having a tilt angle relative to the housing of greater than 20°

These and other aspects, objects, features, and embodiments will be apparent from the following description and the appended claims.

BRIEF DESCRIPTION OF THE DRAWINGS

The drawings illustrate only example embodiments of adjustable light fixtures and are therefore not to be considered limiting of its scope, as adjustable light fixtures may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
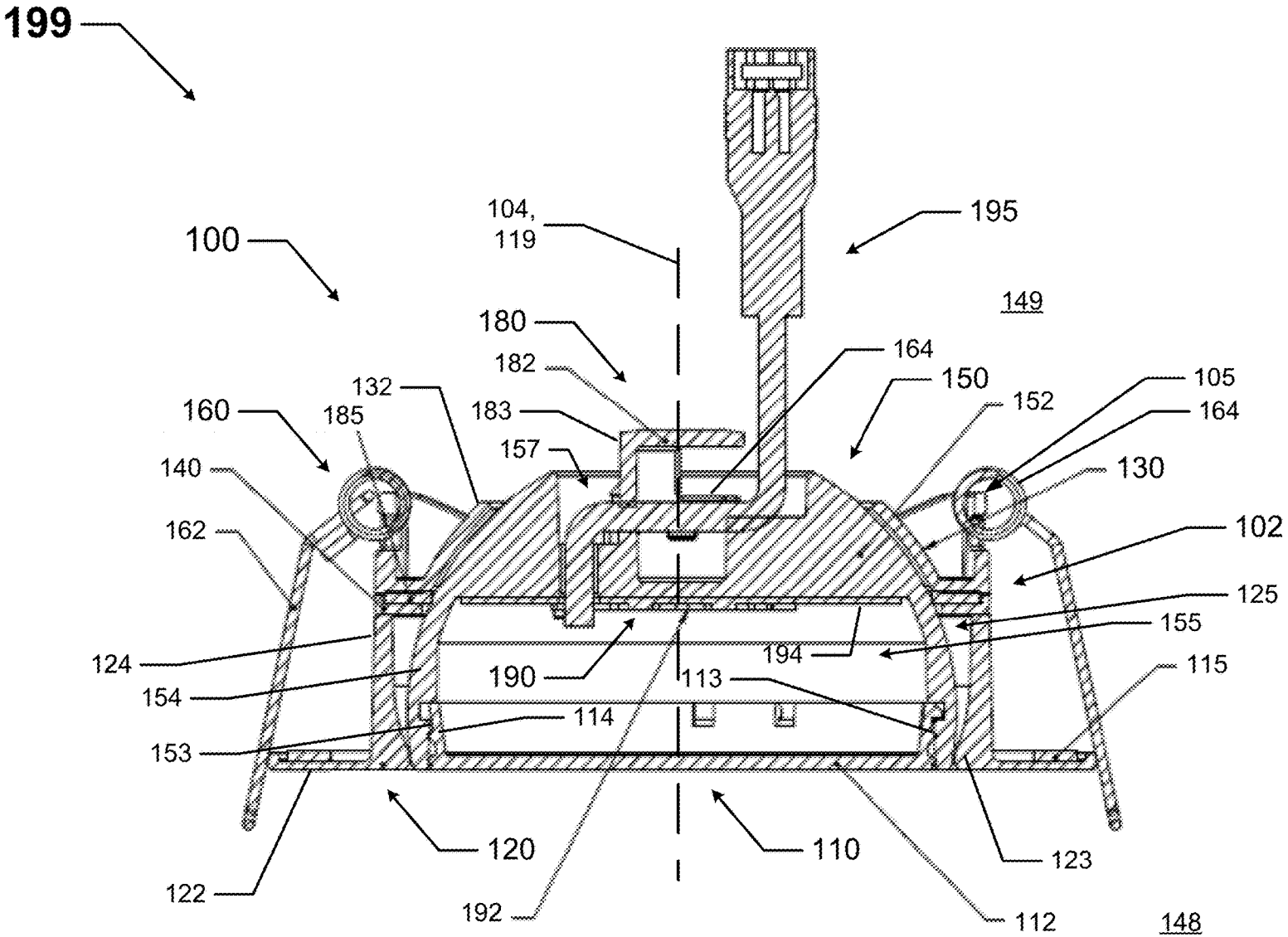
FIGS. 1A and 1B show a cross-sectional side view and a top view, respectively, of a subassembly that includes an adjustable light fixture in a nominal position in accordance with certain example embodiments.

The example embodiments discussed herein are directed to systems, methods, and devices for adjustable light fixtures. Example embodiments can be used with any type of light fixture. Further, example embodiments can be located in any environment (e.g., indoor, outdoor, high humidity, low temperature, sterile, high vibration). Further, adjustable light fixtures described herein can use one or more of a number of different types of light sources, including but not limited to light-emitting diode (LED) light sources, organic LEDs, fluorescent light sources, organic LED light sources, incandescent light sources, and halogen light sources. Therefore, light fixtures described herein should not be considered limited to a particular type of light source. When an adjustable light fixture uses LED light sources, those LED light sources can include any type of LED technology, including, but not limited to, chip on board (COB) and discrete die.

A user may be any person that interacts with an example adjustable light fixture. Examples of a user may include, but are not limited to, a homeowner, a tenant, a landlord, a property manager, an engineer, an electrician, an instrumentation and controls technician, a mechanic, an operator, a consultant, a contractor, an asset, a network manager, and a manufacturer's representative. Example adjustable light fixtures (including components thereof) described herein can be made of one or more of a number of materials, including but not limited to plastic, thermoplastic, copper, aluminum, rubber, stainless steel, and ceramic.

In certain example embodiments, example adjustable light fixtures are subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures, including standards for wet locations and air-tight ratings. Use of example embodiments described herein can meet such standards when required.

Any example adjustable light fixtures, or components thereof (e.g., example housings and bodies), described herein can be made from a single piece (e.g., as from a mold, injection mold, die cast, 3-D printing process, extrusion process, stamping process, or other prototype methods). In addition, or in the alternative, an example adjustable light fixture (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, tabs, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of an example adjustable light fixture to become coupled, directly or indirectly, to another portion of the light fixture and/or a component (e.g., a ceiling, an electrical cable) external to the light fixture. A coupling feature can include, but is not limited to, a snap, a clamp, a portion of a hinge, an aperture, a recessed area, a protrusion, a slot, a spring clip, a tab, a detent, and mating threads. One portion of an example adjustable light fixture can be coupled to another component of the light fixture by the direct use of one or more coupling features.

In addition, or in the alternative, a portion of an example adjustable light fixture can be coupled to another component of the light fixture using one or more independent devices that interact with one or more coupling features disposed on a component of the light fixture. Examples of such devices can include, but are not limited to, a pin, a hinge, a fastening device (e.g., a bolt, a screw, a rivet), epoxy, a sealing member (e.g., an O-ring, a gasket), glue, adhesive, tape, and a spring. One coupling feature described herein can be the same as, or different than, one or more other coupling features described herein. A complementary coupling feature (also sometimes called a corresponding coupling feature) as described herein can be a coupling feature that mechanically couples, directly or indirectly, with another coupling feature.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of adjustable light fixtures will be described more fully hereinafter with reference to the accompanying drawings, in which example embodiments of adjustable light fixtures are shown. Adjustable light fixtures may, however, be embodied in many different forms and should not be construed as limited to the example embodiments set forth herein. Rather, these example embodiments are provided so that this disclosure will be thorough and complete, and will fully convey the scope of adjustable light fixtures to those or ordinary skill in the art. Like, but not necessarily the same, elements (also sometimes called components) in the various figures are denoted by like reference numerals for consistency.

Terms such as "first", "second", "top", "bottom", "lower", "upper", "side", "front", "distal", "proximal", and "within" are used merely to distinguish one component (or part of a component or state of a component) from another. Such terms are not meant to denote a preference or a particular orientation, and are not meant to limit embodiments of adjustable light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
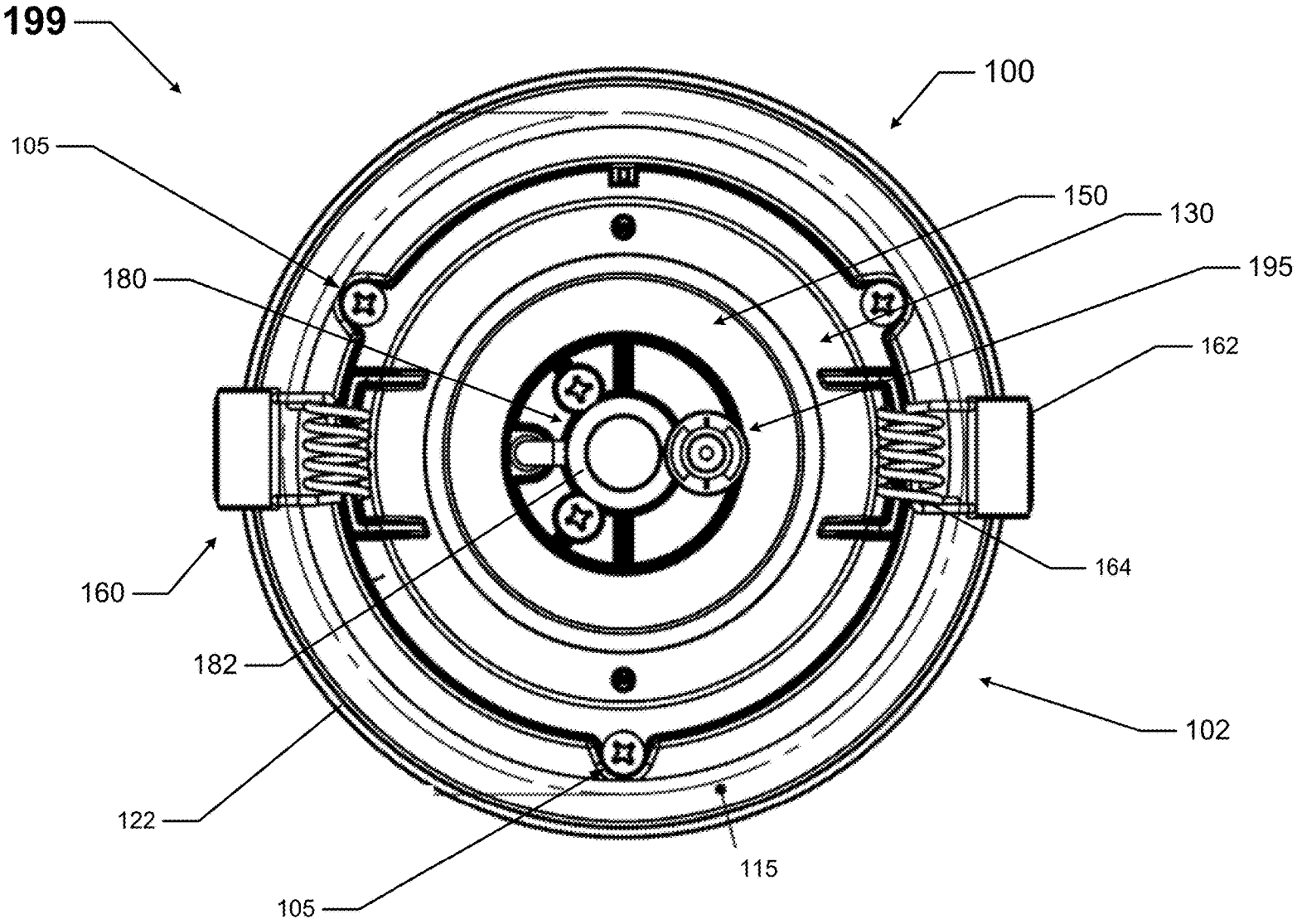

FIGS. 1A and 1B show a cross-sectional side view and a top view, respectively, of a subassembly 199 that includes an adjustable light fixture 100 in a nominal position in accordance with certain example embodiments. In addition to the adjustable light fixture 100, the subassembly 199 of FIGS. 1A and 1B includes a cable assembly 195. The cable assembly 195 includes one or more electrical cables, where each electrical cable has one or more electrical conductors. Further, each electrical cable of the cable assembly 195 can have one or more coupling features (e.g., electrical connector ends) that can couple to one or more components (e.g., a circuit board 194) of the adjustable light fixture 100 and/or another component (e.g., a junction box, another cable assembly) of a light fixture assembly.

Figure 3:
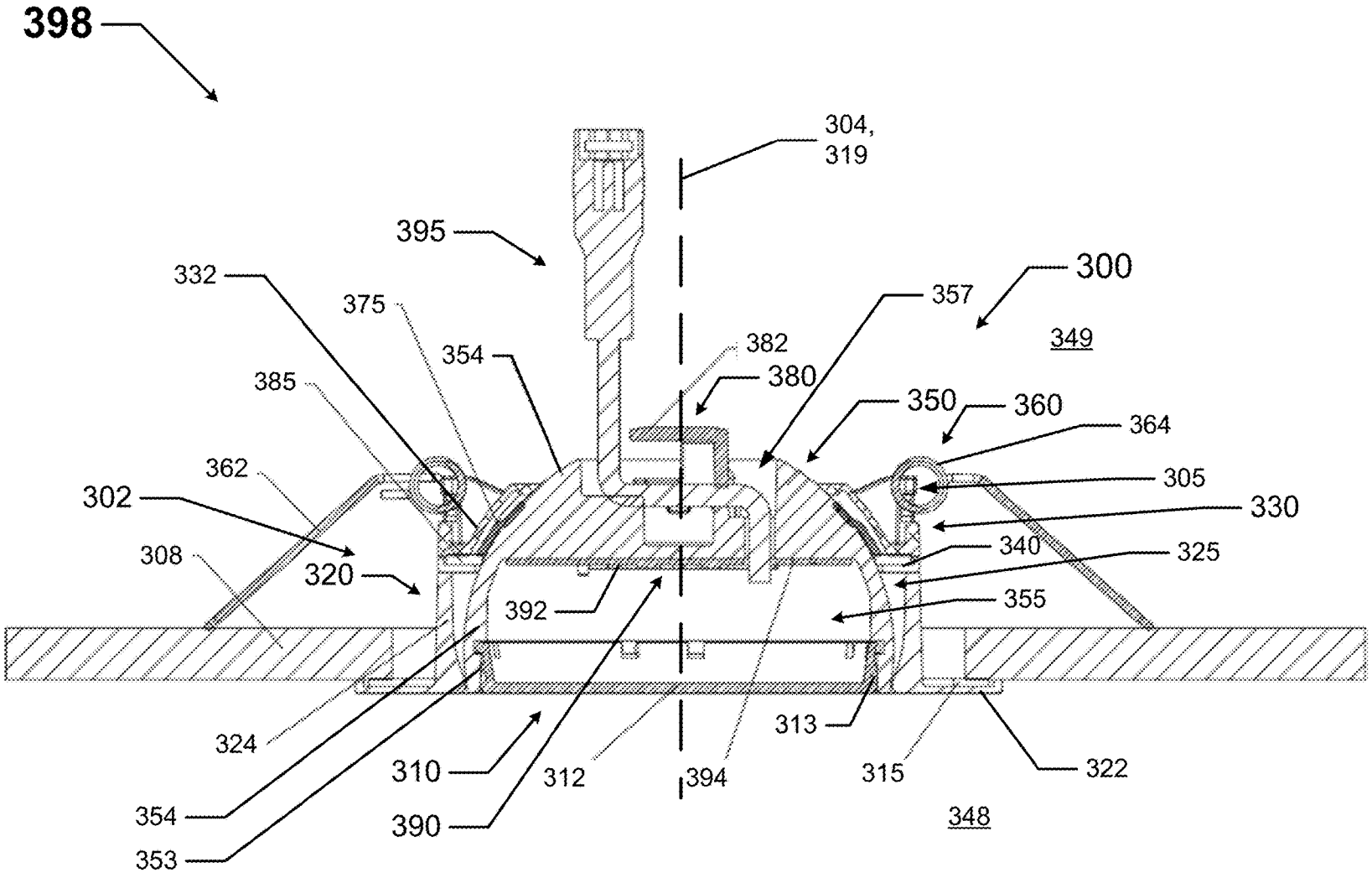
FIG. 3 shows a cross-sectional side view of another subassembly that includes an adjustable light fixture in a nominal position in accordance with certain example embodiments.
Figure 4:
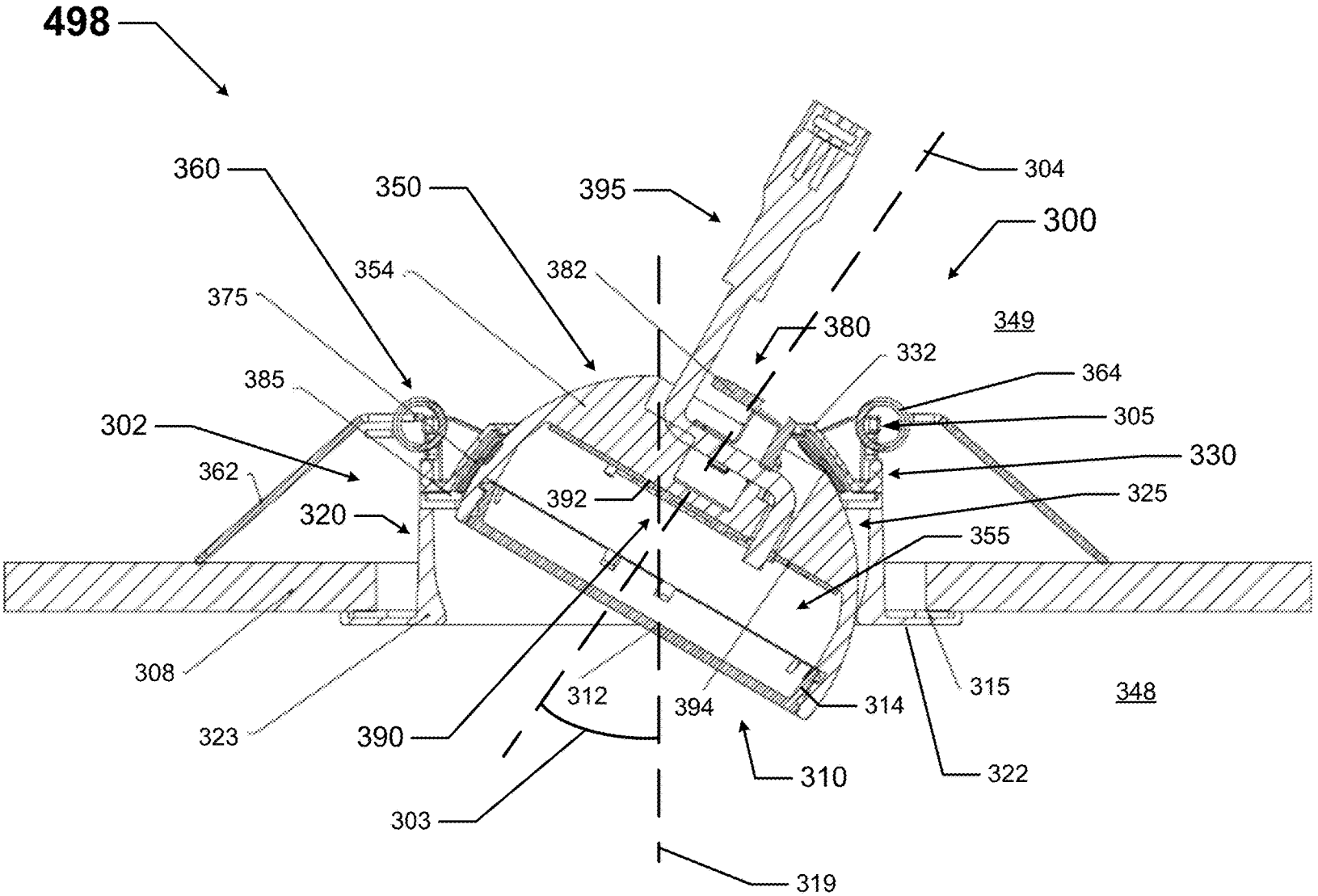
FIG. 4 shows a cross-sectional side view of a subassembly that includes the adjustable light fixture of FIG. 3 in a tilted position.

The example adjustable light fixture 100 of FIGS. 1A and 1B can include a number of different components. For example, in this case, the adjustable light fixture 100 includes a housing 102, a body 150 (sometimes referred to as a gimbal), at least one sealing member 185, one or more optional friction blocks (as shown in FIGS. 3 and 4 below), and one or more coupling features 160. Similarly, one or more of these components of the adjustable light fixture 100 can have one or more of its own components or portions. For example, in this case, the housing 102 can have an upper portion 130 and a lower portion 120. As another example, as in FIGS. 1A and 1B, the body 150 can include an optical assembly 110, a mechanical stop 180, and a light source assembly 190.

In certain example embodiments, the housing 102 of the adjustable light fixture 100 includes at least one wall (e.g., wall 124, wall 132) that forms at least one cavity. In this case, the walls of the housing 102 form a single cavity 125 in which the body 150 and the sealing member 185 are disposed. The shape and size of the cavity 125 can be designed to perform multiple functions. First, the shape and size of the cavity 125 can be configured to receive and retain the body 150 of the adjustable light fixture 100 while allowing the body 150 to move within a range of positions while disposed in the cavity 125.

Figure 2:
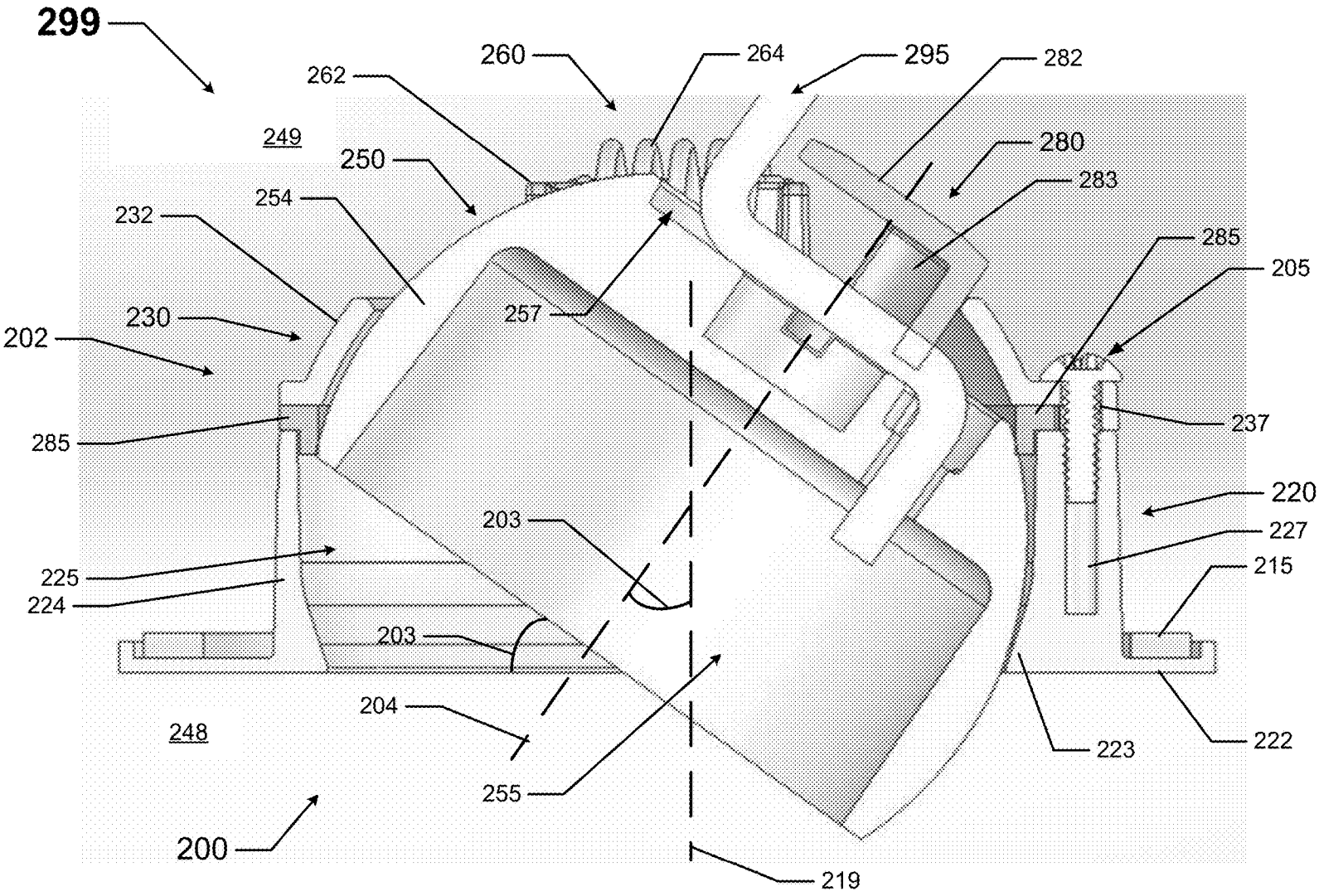
FIG. 2 shows a cross-sectional side view of another subassembly that includes another adjustable light fixture in a tilted position in accordance with certain example embodiments.

In FIG. 1A, the body 150 is shown in a nominal position (i.e., pointing straight down, so that the bottom surface of the body 150 is parallel with the bottom end 123 of the housing 102, and so that the central axis 104 of the body 150 and the central axis 119 of the housing 102 are aligned or in parallel with each other). However, as shown in FIGS. 2 and 4, the body 150 can also have an angle of tilt in any direction, and the cavity 125 of the housing 102 can be shaped and sized to accommodate all of these positions of the body 150. One way that this can be accomplished is to have the bottom end 123 of the housing 102 tapered inward, narrowing the opening of the cavity 125 at the bottom of the housing 102 relative to, for example, the middle (in terms of height) of the cavity 125.

In some cases, the housing 102 can be made of a single piece. Alternatively, as stated above, the housing 102 can include multiple portions that are coupled to each other. In this example, the housing 102 has the upper portion 130 and the lower portion 120 that are coupled to each other using a number (in this case, three) coupling features 105. In this case, the coupling features 105 are screws. In some cases, as in this example, the sealing member 185 is at least partially disposed between two portions (in this case, lower portion 120 and upper portion 130) of the housing 102.

In addition to the sealing member 185, also disposed between the lower portion 120 and upper portion 130 of the housing 102 in this case is at least one bracket 140 (an optional component) that is used to help maintain the position of the sealing member 185 when the body 150 is moved from one position to another position within the cavity 125. The bracket 140 can be an independent piece that is disposed between the lower portion 120 and upper portion 130 of the housing 102. Alternatively, the bracket can be integrated with the lower portion 120 or upper portion 130 of the housing 102.

In certain example embodiments, regardless of how many portions make up the housing 102 and whether other components, such as the at least one optional bracket 140, are included in the housing 102, the housing 102, at least from the bottom up to the point where the sealing member 185 is located, is air-tight and water-tight. In this way, the housing 102 can prevent water, dust, and other contaminants from traversing therethrough. Such a configuration can be required to meet certain standards and/or codes that can apply to the environment and/or location in which the adjustable light fixture 100 is disposed.

Disposed along an inner surface of one or more walls of the housing 102 can be a channel inside of which the one or more sealing members 185 can be disposed. As discussed above, the channel can be formed between two adjoining portions of the housing 102. Alternatively, the sealing member 185 can be disposed within a channel formed in an inner surface of the housing 102. One or more additional components (e.g., the at least one bracket 140) can be used additionally or alternatively to maintain the position of the sealing member 185 within the cavity 125 as the body 150 moves between positions.

The sealing member 185 of the adjustable light fixture 100 can be one or more components that are designed to create a seal between the ambient environment 148 on one side of the sealing member 185 and a protected environment 149 on the other side of the sealing member 185. The seal or barrier created by the sealing member 185 can be configured to keep water, dust, and other contaminants from the ambient environment 148 from getting into the protected environment 149. The sealing member 185 in this case is coupled to the housing 102 and abuts against the outer surface of the body 150, regardless of the position of the body 150 relative to the housing 102.

In addition to acting as a barrier between the ambient environment 148 and the protected environment 149, the sealing member 185 can perform one or more of a number of other functions. For example, the sealing member 185 can be made of a material (e.g., rubber) that has a relatively high coefficient of friction so that, by abutting against the outer surface of the body 150, the sealing member 185 can maintain the position of the body 150 relative to the housing 102 until a user applies a sufficient force to overcome the frictional force applied to the body 150 by the sealing member 185 to move the body 150 to a new position. When the body 150 comes to rest in the new position, the sealing member 185 can applies its frictional force to the body 150 to maintain the body 150 in the new position relative to the housing 102.

The sealing member 185 can have any of a number of configurations and can be made of one or more of any number of materials. For example, the sealing member 185 can be a rubber gasket. As another example, the sealing member 185 can be a nylon O-ring. As yet another example, the sealing member 185 can include a rubber gasket with a metal band clamped over the outer perimeter of the rubber gasket, where the metal band is wedged into a channel formed on the inner surface of one or more walls of the housing 102.

As discussed above, an example adjustable light fixture 100 can include one or more coupling features 160. Each coupling feature 160 can be used to secure the adjustable light fixture 100 against a structure (e.g., a ceiling tile, drywall, wood). A coupling feature 160 can have any of a number of configurations and have any of a number of components. Such coupling features 160 can be common to those found in existing light fixtures. For example, as shown in FIGS. 1A and 1B, a coupling feature 160 can be a retention spring assembly that includes a clip 162 coupled to a spring 164. In this case, the spring 164 is mounted to the housing 102.

The housing 102 can also include a trim 122 that extends laterally away from the bottom end of the wall 124 of the housing 102. The trim 122 can be a decorative element of the housing 102 that can cover any gap between the housing 102 and a structure (e.g., a ceiling tile, drywall, wood) to which the housing 102 is mounted. The trim 122 can also be used for one or more of a number of other purposes. For example, the trim 122 can be used to provide a seal or barrier with the structure. In such a case, as shown in FIG. 1A, the top side of the trim 122 can have a channel inside of which a sealing member 115 can be disposed. In such a case, the sealing member 115 can be compressed between the trim 122 and the structure (as shown, for example, in FIGS. 3 and 4 below) to prevent air, dust, and/or other contaminants from traversing from the ambient environment 148 to the protected environment 149. As with the sealing member 185, the sealing member 115 can have any of a number of configurations (e.g., O-ring, gasket, silicone) and can be made of one or more of any number of materials.

The body 150 of the adjustable light fixture 100 is configured to be disposed, at least in part, within the cavity 125 formed by the housing 102. The body 150 can have any of a number of configurations. For example, as in this case, the outer perimeter of the body 150 can generally be a sphere that is truncated at the bottom end and the top end. At least some of this shape of the body 150 can be directly complimented by the shape of one or more walls of the housing 102. For example, as shown in FIG. 1A, part of the wall 132 of the upper portion 130 of the housing 102 matches the shape of the body 150.

The body 150 can have multiple portions. For example, as shown in FIG. 1A, approximately the bottom half of the body 150 includes one or more walls 154 that form a cavity 155. This cavity 155 can be open (unbounded by a wall) at the bottom. Disposed within the cavity 155 can be one or more components of the adjustable light fixture 100. For example, as shown in FIG. 1A, a light source assembly 190 can be disposed at the top of the cavity 155. The light source assembly 190 generates and emits light into the ambient environment 148. The light source assembly 190 in this case includes one or more light sources 192 disposed on a circuit board 194. In some cases, the body 150 (or portions thereof) can be made of a thermally-conductive material (e.g., aluminum, thermoplastic) that absorbs heat generated by the light source assembly 190 and dissipates that heat in the ambient environment 148 and/or the protected environment 149.

As another example, an optional optical device 110 can be disposed at the bottom of the cavity 155. The optical device 110 can include one or more of a number of components, such as a lens 112 as shown in FIG. 1A. The optical device 110 can be used to manipulate (e.g., refract, reflect) the light generated by the light source assembly 190 before that light is emitted into the ambient environment 148. The optical device 110 can be integrated with the body 150 as a single piece.

Alternatively, the optical device 110 can be permanently or removably coupled to the body 150. For example, as shown in FIG. 1B, the inner surface of the distal end of the wall 154 of the body 150 can have one or more coupling features 153 (e.g., mating threads, tabs, recesses) disposed thereon. Similarly, the outer surface of a wall of the optical device 110 can include one or more coupling features 113 disposed on an outer wall 114 of the optical device 110, where the coupling features 113 of the optical device 110 complement the coupling features 153 of the body 150. Such a configuration can allow a user to have a desired optical effect (e.g., beam forming, light dispersion) at a given point in time by merely changing out one optical device 110 for another.

Another optional portion of the body 150 is one or more mechanical stops. A mechanical stop can limit an amount of tilt and/or a range of rotation of the body 150 relative to the housing 102. For example, FIGS. 1A and 1B show an example of a mechanical stop 180 that is mounted atop the body 150. In this case, the mechanical stop 180 limits the amount of tilt of the body 150 relative to the housing 102 by contacting a wall 132 of the housing 102. Examples of this are shown in FIGS. 2 and 4 below. A mechanical stop 180 can be a separate component that is permanently or removably coupled to the body 150. Alternatively, a mechanical stop 180 can be integrated with the body 150 as a single piece.

In this case, the mechanical stop 180 provides the added function of receiving and securing part of the cable assembly 195. A mechanical stop 180 can have any of a number of configurations. For example, the mechanical stop 180 of FIGS. 1A and 1B has a cylindrical shape, with a top wall 182, a partial side wall 183, and a partial bottom wall 184. In this case, some of the mechanical stop 180, as well as part of the cable assembly 195, are disposed in a cavity 157 formed at the top of the body 150.

FIG. 2 shows a cross-sectional side view of another subassembly 299 that includes another adjustable light fixture 200 in a tilted position in accordance with certain example embodiments. Referring to FIGS. 1A through 2, the adjustable light fixture 200 of FIG. 2 (including its various components) is substantially similar to the adjustable light fixture 100 of FIGS. 1A and 1B (including its various corresponding components), except as described below. For example, the adjustable light fixture 200 of FIG. 2 includes a cable assembly 295.

Also, the adjustable light fixture 200 of FIG. 2 includes a housing 202, a body 250, a sealing member 285, and one shown coupling feature 260. The housing 202 has an upper portion 230 and a lower portion 220 that are coupled to each other using at least one coupling feature 205 (in this case, a screw). Each coupling feature 205 is disposed in a threaded aperture 237 in the upper portion 230 of the housing 202 and in a threaded aperture 227 in the lower portion 220 of the housing 202. The lower portion 220 of the housing 202 has at least one wall 224, and the upper portion 230 of the housing 202 has at least one wall 232.

The bottom end 223 of the housing 202 is tapered inward, narrowing the opening of the cavity 225 at the bottom of the housing 202 relative to the middle (in terms of height) of the cavity 225. In this case, there is no bracket (as was the case with the bracket 140 of FIG. 1A) to help maintain the position of the sealing member 285 when the body 250 is moved from one position to any other position within the cavity 225. Instead, the sealing member 285 is sandwiched between the lower portion 220 and the upper portion 230 of the housing 202 on its own. Also, the sealing member 285 in this case is non-planar, having a downward bend within the cavity 225. The sealing member 285 prevents water, dust, and other contaminants from traversing therethrough from the ambient environment 248 to the protected environment 249, regardless of the position of the body 250 relative to the housing 202.

The sealing member 285 is disposed within a channel formed between the upper portion 230 and the lower portion 220 of the housing 202. Also, one or more brackets 240 are also disposed within the channel (or helps form the channel) to maintain the position of the sealing member 285 within the cavity 225 as the body 250 moves between positions. In addition to acting as a barrier between the ambient environment 248 and the protected environment 249, the sealing member 285 maintains the position of the body 250 relative to the housing 202.

The adjustable light fixture 200 of FIG. 2 also includes one or more coupling features 260, which in this case is a retention spring assembly that includes a clip 262 coupled to a spring 264. In this case, the spring 264 is mounted to the housing 202. The housing 202 can also include a trim 222 that extends laterally away from the bottom end of the wall 224 of the housing 202. The top side of the trim 222 has a channel inside of which a sealing member 215 can be disposed.

The body 250 of the adjustable light fixture 200 is generally in the shape of a sphere that is truncated at the bottom end and the top end. At least some of this shape of the body 250 is directly complimented by the shape of some of the wall 232 of the upper portion 230 of the housing 202. The approximate bottom half of the body 250 includes one or more walls 254 that form a cavity 255. This cavity 255 is open (unbounded by a wall) at the bottom. In this case, there is no light source assembly (e.g., light source assembly 190) or optical device (e.g., optical device 110) disposed within the cavity 255.

The adjustable light fixture 200 of FIG. 2 also includes a mechanical stop 280 that is mounted atop the body 250. As shown in FIG. 2, the mechanical stop 280 limits the amount of tilt of the body 250 relative to the housing 202 by contacting a wall 232 of the upper portion 230 of the housing 202. In this case, the mechanical stop 280 limits the tilt of the body 250 to an angle 203 (e.g., 30°, 35°) relative to the housing 202, where the angle 203 is defined between the trim 222 and the bottom surface of the body 250 (or, alternatively, between the central axis 204 of the body 250 and the central axis 219 of the housing 202).

The mechanical stop 280 in this case does not limit the range of rotation of the body 250 relative to the housing 202. The mechanical stop 280 shown in FIG. 2 also receives and secures part of the cable assembly 295. The mechanical stop 280 of FIG. 2 has a cylindrical shape, with a top wall 282, a partial side wall 283, and a partial bottom wall (hidden from view). In this case, some of the mechanical stop 280, as well as part of the cable assembly 295, are disposed in a cavity 257 formed at the top of the body 250. This configuration of the adjustable light fixture 200 allows for increased tilt (e.g., beyond 20°) and range of rotational movement of the body 250 relative to the housing 202 relative to currently-existing light fixtures, while allowing the adjustable light fixture 200 to comply with applicable standards and regulations relative to environmental (e.g., water, dust) conditions and requirements.

At times, when the body 250 is tilted beyond a certain angle 203 relative to the housing 202, the inner surface of the housing 202 (e.g., the inner surface of wall 224 of the lower portion 220 of the housing 202) can affect one or more characteristics of the light emitted by the light assembly of the light fixture 200. For example, flashback of the emitted light can result. To minimize these undesired effects, in certain example embodiments, the inner surface of one or more walls of the housing 202 can be altered, treated, or otherwise manipulated. For example, the inner surface of wall 224 of the lower portion 220 of the housing 202 can be painted black to avoid flashback or flashing of the inner surface of the wall 224.

FIG. 3 shows a cross-sectional side view of another subassembly 398 that includes an adjustable light fixture 300 in a nominal position in accordance with certain example embodiments. FIG. 4 shows a cross-sectional side view of a subassembly 498 that includes the adjustable light fixture of FIG. 3 in a tilted position. Referring to FIGS. 1A through 4, the adjustable light fixture 300 of FIGS. 3 and 4 (including its various components) is substantially similar to the adjustable light fixture 100 of FIGS. 1A and 1B (including its various corresponding components) and the adjustable light fixture 200 of FIG. 2, except as described below. For example, the adjustable light fixture 300 of FIGS. 3 and 4 includes a cable assembly 395 and is mounted to a structure 308, which in this case is a ceiling.

Also, the adjustable light fixture 300 of FIGS. 3 and 4 includes a housing 302, a body 350, a sealing member 385, and multiple coupling features 360. The housing 302 has an upper portion 330 and a lower portion 320 that are coupled to each other using at least one coupling feature 305 (in this case, a screw). The lower portion 320 of the housing 302 has at least one wall 324, and the upper portion 330 of the housing 302 has at least one wall 332.

The bottom end 323 of the housing 302 is tapered inward, narrowing the opening of the cavity 325 at the bottom of the housing 302 relative to the middle (in terms of height) of the cavity 325. In addition to the sealing member 385, disposed between the lower portion 320 and upper portion 330 of the housing 302, is at least one bracket 340 that is used to help maintain the position of the sealing member 385 when the body 350 is moved from one position to another position within the cavity 325. The sealing member 385 prevents water, dust, and other contaminants from traversing therethrough from the ambient environment 348 to the protected environment 349.

The sealing member 385 is disposed within a channel formed between the upper portion 330 and the lower portion 320 of the housing 302. Also, one or more brackets 340 are also disposed within the channel (or helps form the channel) to maintain the position of the sealing member 385 within the cavity 325 as the body 350 moves between positions. In addition to acting as a barrier between the ambient environment 348 and the protected environment 349, the sealing member 385 maintains the position of the body 350 relative to the housing 302.

In some cases, while the sealing member 385 can be effective in preventing water, dust, and other contaminants from traversing therethrough from the ambient environment 348 to the protected environment 349, the sealing member 385 by itself may not be effective in maintaining a position of the body 350 relative to the housing 302, particularly over time and/or after a number of changes in position of the body 350 relative to the housing 302. In such a case, one or more optional other components can be used to help maintain the position of the body 350 relative to the housing 302.

For example, as shown in FIGS. 3 and 4, one or more friction blocks 375 can be disposed between the inner surface of the housing 302 and the outer surface of the body 350. In this case, the friction block 375 is disposed adjacent to and above the sealing member 385 in the protected environment 349. A friction block 375 can be an independent component, part of the housing 302, part of the body 350, or part of the sealing member 385. A friction block 375 can have one or more of any number of configurations and features, and can be made of one or more of any number of materials.

For example, as in this case, a friction block 375 can act as a type of finger that press against the outer surface of the body 350 at multiple points. If the outer surface of the body 350 is featureless (e.g., smooth), then the friction block 375 can allow for a continuous or infinite number of positions of the body 350 relative to the housing 302. Alternatively, the outer surface of the body 350 can have any of a number of features (e.g., detents, recesses) that can allow for a discrete (even if a large) number of positions of the body 350 relative to the housing 302. These positions can be in terms of tilt and/or rotation of the body 350 relative to the housing 302.

The adjustable light fixture 300 of FIGS. 3 and 4 also includes multiple coupling features 360, which in this case is a retention spring assembly that includes a clip 362 coupled to a spring 364. In this case, the spring 364 is mounted to the housing 302. The housing 302 also includes a trim 322 that extends laterally away from the bottom end of the wall 324 of the housing 302. The top side of the trim 322 has a channel inside of which a sealing member 315 can be disposed. When the adjustable light fixture 300 is positioned relative to the structure 308 as shown in FIGS. 3 and 4, the spring 364 forces the clip 362 against the top side of the structure 308, thereby forcing the trim 322 upward against the bottom side of the structure 308.

The body 350 of the adjustable light fixture 300 is generally in the shape of a sphere that is truncated at the bottom end and the top end. At least some of this shape of the body 350 is directly complimented by the shape of some of the wall 332 of the upper portion 330 of the housing 302. The approximate bottom half of the body 350 includes one or more walls 354 that form a cavity 355. This cavity 355 is open (unbounded by a wall) at the bottom in the absence of the optical device 310.

Disposed within the cavity 355 in FIGS. 3 and 4 are a light source assembly 390 and the optical device 310. The light source assembly 390 in this case includes one or more light sources 392 disposed on a circuit board 394. The optical device 310 is disposed at the bottom of the cavity 355. The optical device 310 in this case includes a lens 312. Also, the optical device 310 is removably coupled to the body 350.

Specifically, the inner surface of the distal end of the wall 354 of the body 350 has one or more coupling features 353 (in this case, mating threads) disposed thereon. Similarly, the outer surface of the outer wall 314 of the optical device 310 can include one or more coupling features 313, where the coupling features 313 of the optical device 310 complement the coupling features 353 of the body 350.

The adjustable light fixture 300 of FIGS. 3 and 4 also includes a mechanical stop 380 that is mounted atop the body 350. As shown in FIG. 4, the mechanical stop 380 limits the amount of tilt of the body 350 relative to the housing 302 by contacting a wall 332 of the upper portion 330 of the housing 302. In this case, the mechanical stop 380 limits the tilt of the body 350 to an angle 303 (e.g., 30°, 35°) relative to the housing 302, where the angle 303 is defined between the trim 322 and the bottom surface of the body 350 (or, alternatively, between the central axis 304 of the body 350 and the central axis 319 of the housing 302). In FIG. 3, the body 350 is in the nominal position (in terms of tilt) relative to the housing 302, and so the angle 303 is 0°.

The mechanical stop 380 in this case does not limit the range of rotation of the body 350 relative to the housing 302. The mechanical stop 380 shown in FIGS. 3 and 4 also receives and secures part of the cable assembly 395. The mechanical stop 380 of FIGS. 3 and 4 has a cylindrical shape, with a top wall 382, a partial side wall 383, and a partial bottom wall (hidden from view). In this case, some of the mechanical stop 380, as well as part of the cable assembly 395, are disposed in the cavity 357 formed at the top of the body 350.

Figure 5:
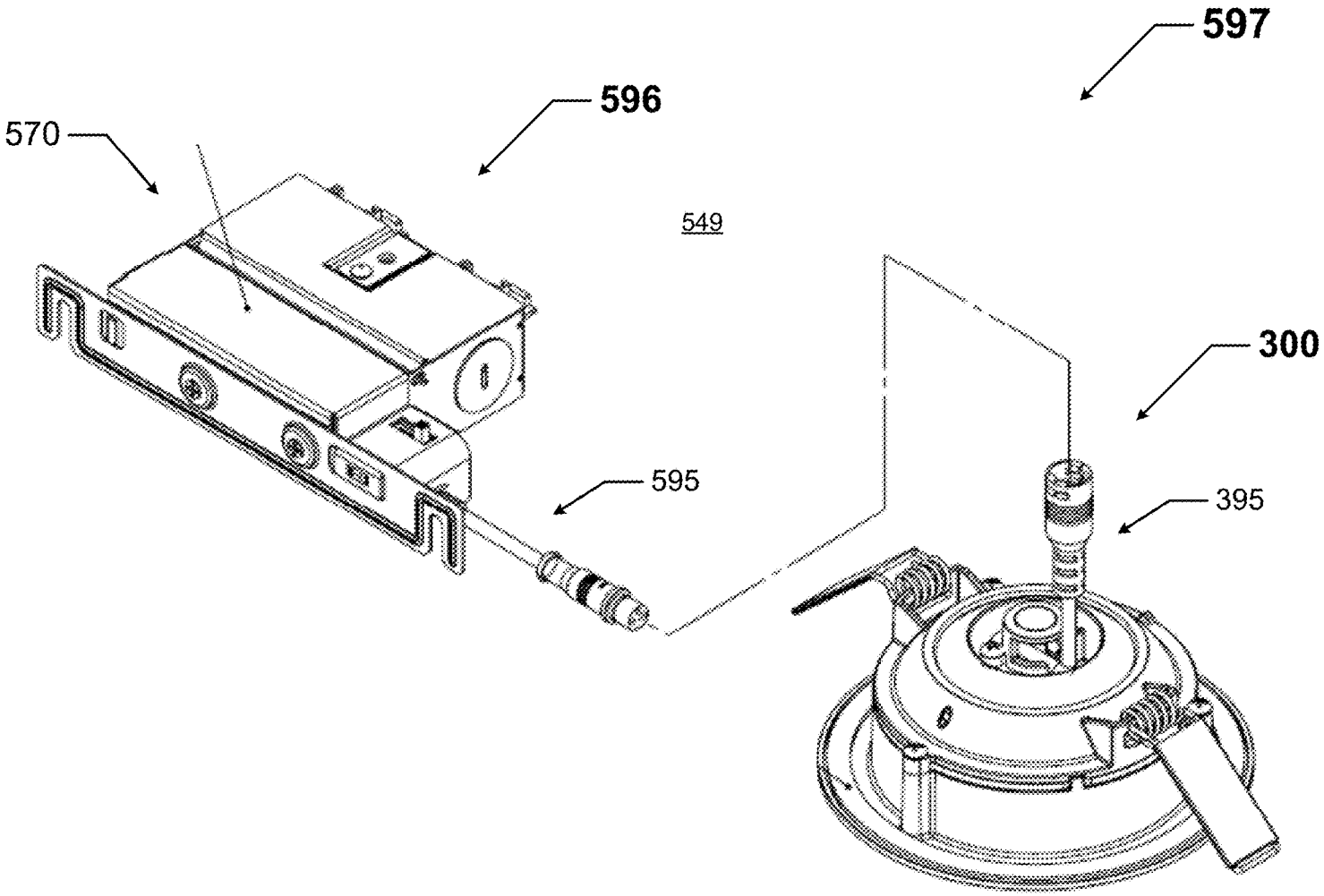
FIG. 5 shows a top-side perspective view of an assembly that includes the subassembly of FIG. 3.

FIG. 5 shows a top-side perspective view of an assembly 597 that includes the adjustable light fixture 300 of FIG. 3. Referring to FIGS. 1A through 5, in addition to the light fixture 300, the assembly 597 of FIG. 5 includes a subassembly 596 that includes a junction box 570 and another cable assembly 595. One end of the cable assembly 595 is coupled to a connector on the junction box 570 or to one or more electrical devices disposed within the junction box 570. The other end of the cable assembly 595 is configured to couple to the exposed end of the cable assembly 395 that extends away from the adjustable light fixture 300. The assembly 597 would normally be located in a protected environment 549, such as above a ceiling or other structure.

FIGS. 6-9 show various trims that can be used with adjustable light fixtures in accordance with certain example embodiments. Referring to FIGS. 1A through 9, as discussed above, the trim (e.g., trim 122) of an example adjustable light fixture can be a decorative piece in addition to serving one or more practical functions. In some cases, in similar ways that the optical assembly can be interchangeable, the trim of an adjustable light fixture can be replaceable and interchangeable. Such a feature may be desired, for example, because the trim is the most visible component of an adjustable light fixture in an ambient environment (e.g., ambient environment 148).

Figure 7:
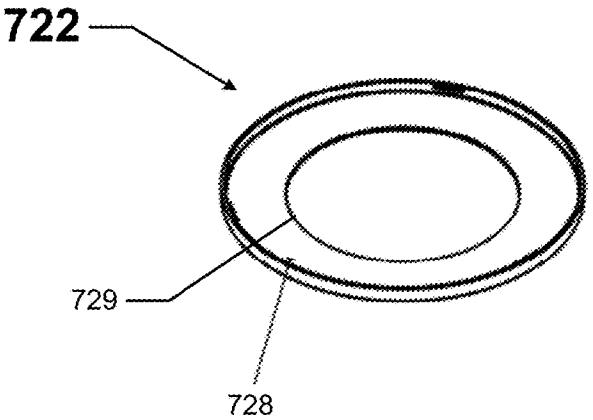
FIGS. 6-9 show various trims that can be used with adjustable light fixtures in accordance with certain example embodiments.
Figure 6:
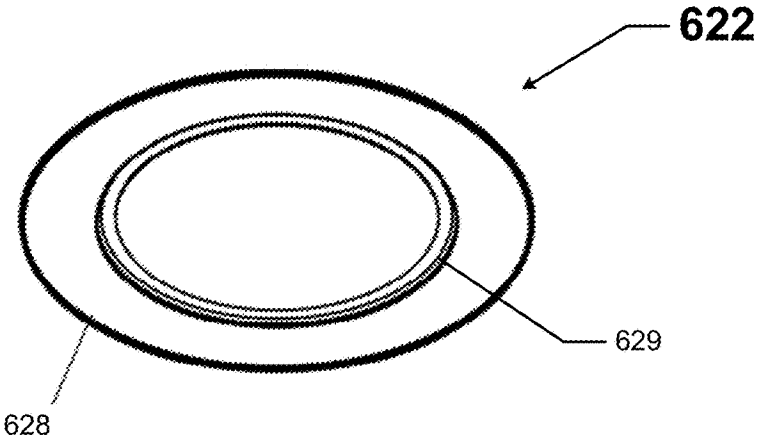

Such a change can be made because of one or more desired characteristics, including but not limited to shape, color, sensor integration, sound absorption, reflectivity, and texture. FIGS. 6-9 show variations in the shape of the trim. Specifically, FIG. 6 shows a trim 622 with a circular outer perimeter 628 and a circular inner perimeter 629, where the inner perimeter 629 has a decorative tiered configuration. FIG. 7 shows a trim 722 with a circular outer perimeter 728 and a circular inner perimeter 729, where the outer perimeter 729 has a decorative tiered configuration.

Figure 9:
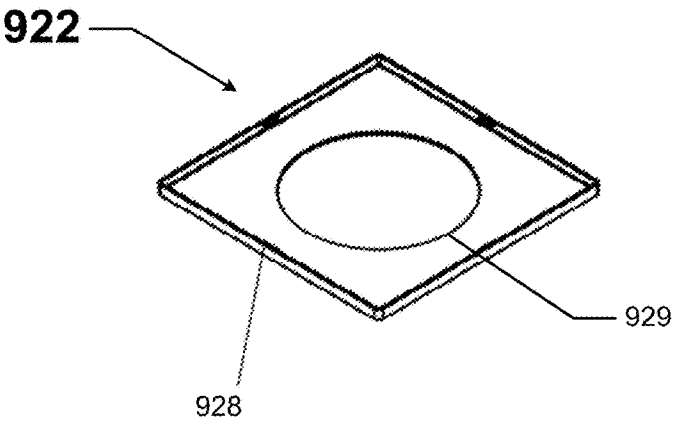
Figure 8:
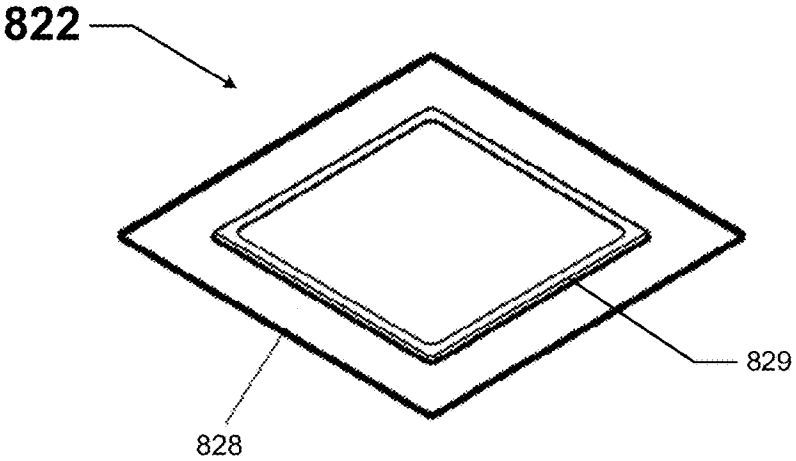

FIG. 8 shows a trim 822 with a square outer perimeter 828 and a square inner perimeter 829, where the inner perimeter 829 has a decorative tiered configuration. FIG. 9 shows a trim 922 with a square outer perimeter 928 and a circular inner perimeter 929, where the outer perimeter 929 has a decorative tiered configuration. In certain example embodiments, the configuration of the trim has no effect on the adjustability of the body relative to the housing of the adjustable light fixture.

In one or more example embodiments, example adjustable light fixtures allow for increased tilt and rotational range of motion of the body relative to the housing, while maintaining the environmental isolation required by applicable standards and regulations for such light fixtures. Adjustments to the example light fixtures can be made by a user without the use of tools. Further, the configuration (e.g., the sealing member disposed within the cavity formed by the housing) of the example adjustable light fixtures allow the body of the light fixture to be held in any desired position. Using example embodiments described herein can improve customer satisfaction and ease of use.

Accordingly, many modifications and other embodiments set forth herein will come to mind to one skilled in the art to which example embodiments pertain having the benefit of the teachings presented in the foregoing descriptions and the associated drawings. Therefore, it is to be understood that example embodiments are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. An adjustable light fixture comprising:

a housing comprising at least one wall that forms a first cavity;

a first sealing member coupled to the at least one wall and at least partially disposed within the first cavity; and a body movably coupled to the housing and at least partially disposed within the first cavity, wherein the body is configured to have a plurality of positions relative to the housing, wherein the first sealing member abuts against an outer surface of the body when the body is in each of the plurality of positions, wherein the first sealing member prevents fluids in an ambient environment from traversing therethrough when the body is in each of the plurality of positions, wherein the plurality of positions includes the body having a tilt angle relative to the housing of greater than 20°.

2. The adjustable light fixture of claim 1, wherein the body comprises at least one light source, wherein the at least one light source emits light from the first cavity into the ambient environment when the body is in any of the plurality of positions.

3. The adjustable light fixture of claim 2, wherein an inner surface of the at least one wall of the housing comprises a material that absorbs a portion of the light emitted by the at least one light source when the housing is in a position where the portion of the light light emitted by the at least one light source is directed toward the at least one wall rather than directly to the ambient environment.

4. The adjustable light fixture of claim 1, wherein the body further comprises an optical device disposed between the at least one light source and the ambient environment.

5. The adjustable light fixture of claim 4, wherein the optical device comprises a lens.

6. The adjustable light fixture of claim 4, wherein the optical device is removably coupled to the housing.

7. The adjustable light fixture of claim 1, wherein the first sealing member retains the body in each position of the plurality of positions.

8. The adjustable light fixture of claim 1, wherein at least one of the plurality of positions comprises the tilt angle of at least 30° in any direction.

9. The adjustable light fixture of claim 1, wherein the first sealing member comprises a gasket disposed within a slot in an inner surface of the at least one wall of the housing.

10. The adjustable light fixture of claim 1, wherein the housing comprises a first portion and a second portion coupled to the first portion, wherein the first sealing member is disposed between the first portion and the second portion.

11. The adjustable light fixture of claim 1, wherein the body further comprises a mechanical stop that contacts the housing when the tilt angle of the body relative to the housing reaches a maximum value.

12. The adjustable light fixture of claim 11, wherein the housing further has a second cavity formed adjacent to the mechanical stop, wherein the second cavity is configured to receive at least one electrical cable for delivering power to the adjustable light fixture.

13. The adjustable light fixture of claim 12, wherein the mechanical stop is further configured to secure the at least one electrical cable in each of the plurality of positions of the body relative to the housing.

14. The adjustable light fixture of claim 1, wherein the first sealing member further prevents air from the ambient environment from passing therethrough.

15. The adjustable light fixture of claim 1, wherein the housing further comprises a trim disposed adjacent to an opening of the first cavity.

16. The adjustable light fixture of claim 15, wherein the housing further comprises a second sealing member disposed within a channel of the trim, wherein the trim and the second sealing member are configured to abut against a first side of a structural element.

17. The adjustable light fixture of claim 16, wherein the housing further comprises at least one securing feature, wherein the at least one securing feature is configured to abut against a second side of the structural element.

18. The adjustable light fixture of claim 17, wherein the at least one securing feature comprises a spring clip.

19. The adjustable light fixture of claim 1, further comprising:

a friction block disposed between the housing and the body, wherein the friction block retains the housing in each position of the plurality of positions.

20. The adjustable light fixture of claim 19, wherein the friction block is disposed adjacent to the first sealing member.

* * * * *